US010508355B2

(12) United States Patent
Yazawa et al.

(10) Patent No.: US 10,508,355 B2
(45) Date of Patent: Dec. 17, 2019

(54) PLATING APPARATUS

(71) Applicant: EBARA CORPORATION, Tokyo (JP)

(72) Inventors: Akihiro Yazawa, Tokyo (JP); Kenichi Kobayashi, Tokyo (JP); Yasuyuki Miyasawa, Tokyo (JP); Tsuyoshi Soma, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 11 days.

(21) Appl. No.: 15/661,817

(22) Filed: Jul. 27, 2017

(65) Prior Publication Data

US 2018/0087176 A1 Mar. 29, 2018

(30) Foreign Application Priority Data

Sep. 28, 2016 (JP) ..... 2016-189742

(51) Int. Cl.
*C25D 17/00* (2006.01)
*C25D 17/06* (2006.01)

(52) U.S. Cl.
CPC ..... *C25D 17/06* (2013.01); *C25D 17/00* (2013.01)

(58) Field of Classification Search
None
See application file for complete search history.

(56) References Cited

U.S. PATENT DOCUMENTS 5,516,732 A * 5/1996 Flegal ..... H01L 21/67167 29/25.01
6,435,199 B1 * 8/2002 Kamikawa ..... H01L 21/67028 134/64 R
2003/0143837 A1 * 7/2003 Gandikota ..... C23C 18/165 438/629
2005/0205209 A1 * 9/2005 Mosden ..... H01L 21/67069 156/345.31
2005/0274603 A1 * 12/2005 Glassman ..... C25D 17/02 204/198
2008/0069672 A1 * 3/2008 Ikehata ..... B65G 1/0407 414/283
2009/0045068 A1 * 2/2009 Sekimoto ..... C25D 5/08 205/133
2010/0006444 A1 * 1/2010 Endo ..... C25D 17/00 205/89
2012/0308344 A1 12/2012 Keigler
(Continued)

FOREIGN PATENT DOCUMENTS

JP 2003-243473 A 8/2003
JP 2007-056361 * 3/2007 ..... C25D 17/16
(Continued)

*Primary Examiner* — Stefanie S Wittenberg
(74) *Attorney, Agent, or Firm* — Baker & Hostetler LLP

(57) ABSTRACT

A plating apparatus enabling a user to conduct maintenance of a substrate holder while an operation of the plating apparatus is being performed is disclosed. The plating apparatus includes: a processing section for plating a substrate; a storage container configured to store the substrate holder for holding the substrate; a transport machine configured to transport the substrate holder between the processing section and the storage container; a maintenance area adjacent to the storage container; and a substrate-holder carrier supported by the storage container. The substrate-holder carrier is movable between the storage container and the maintenance area while supporting the substrate holder.

16 Claims, 21 Drawing Sheets

(56) References Cited

U.S. PATENT DOCUMENTS

| | | | | |
|---|---|---|---|---|
| 2015/0013905 | A1* | 1/2015 | Nakagawa | C23C 18/1632<br>156/345.23 |
| 2016/0211157 | A1* | 7/2016 | Inoshima | H01L 21/67276 |

FOREIGN PATENT DOCUMENTS

| | | | | | |
|---|---|---|---|---|---|
| JP | 2008-068964 | A | | 3/2008 | |
| JP | 2009-006802 | A | | 1/2009 | |
| JP | 2012-112026 | A | | 6/2012 | |
| WO | WO2015030047 | | * | 3/2015 | H01L 21/205 |

* cited by examiner

PLATING APPARATUS

CROSS REFERENCE TO RELATED APPLICATION

This document claims priority to Japanese Patent Application Number 2016-189742 filed Sep. 28, 2016, the entire contents of which are hereby incorporated by reference.

BACKGROUND

There is known a plating apparatus for plating a substrate held by a substrate holder. In such a plating apparatus, the substrate holder is stored in a storage container before an operation of the plating apparatus, and is taken out of the storage container when the operation of the plating apparatus is started. The substrate, such as a wafer, is set on the substrate holder, and the substrate holder with the substrate held thereon is transported to a processing section by a transport machine. The substrate is then plated in the processing section.

When the substrate is set on the substrate holder, the substrate is checked whether the substrate is properly set on the substrate holder. If the substrate is not properly set on the substrate holder, the substrate holder is returned to the storage container without being transported to the processing section, and then a worker conducts maintenance of the substrate holder.

In recent years, a size of a substrate conspicuously tends to increase in a substrate processing apparatus including the plating apparatus. As the size of the substrate increases, a size of a substrate holder increases and its weight also increases. Maintenance of the substrate holder is conventionally performed by carrying the substrate holder into a maintenance area outside the apparatus. However, such an operation of carrying the substrate holder with an increased weight to the maintenance area outside the apparatus entails a large load on the worker (a load in terms of time and work).

In the meantime, the transport machine for transporting the substrate holder continuously passes over the storage container during the operation of the apparatus. Under such a circumstance, for maintenance of the substrate holder, when the worker tries to take the substrate holder out of the storage container, the worker may collide with the moving substrate holder or the moving transport machine. Therefore, during the maintenance work of the substrate holder, the apparatus was forced to stop its operation. However, the stoppage of the operation of the plating apparatus for maintenance of the substrate holder results in a lowered operation rate of the apparatus and a lowered productivity.

SUMMARY OF THE INVENTION

According to an embodiment, there is provided a plating apparatus enabling a user to conduct maintenance of a substrate holder while an operation of the plating apparatus is being performed.

Embodiments, which will be described below, relate to a plating apparatus.

In an embodiment, there is provided a plating apparatus comprising: a processing section for plating a substrate; a storage container configured to store a substrate holder for holding the substrate; a transport machine configured to transport the substrate holder between the processing section and the storage container; a maintenance area adjacent to the storage container; and a substrate-holder carrier supported by the storage container, the substrate-holder carrier being movable between the storage container and the maintenance area while supporting the substrate holder.

In an embodiment, the plating apparatus further comprising: a partition arranged between the maintenance area and the storage container, the partition being located higher than the storage container.

In an embodiment, the substrate-holder carrier includes: a base on which the substrate holder is placed; and a rolling element attached to the base, the rolling element being in contact with the storage container.

In an embodiment, the plating apparatus further comprising: a maintenance structure located in the maintenance area, the maintenance structure being configured to receive the substrate holder and the substrate-holder carrier, wherein the storage container includes a first guide rail for supporting the rolling element, the maintenance structure includes a second guide rail for supporting the rolling element, and the second guide rail is configured to be able to be aligned with the first guide rail.

In an embodiment, the maintenance structure includes: a work table secured to the second guide rail and extending downwardly from the second guide rail; and a support member rotatably supporting the work table.

In an embodiment, a plurality of substrate-holder carriers are arranged on the storage container; and the maintenance area extends parallel to an arrangement direction of the substrate-holder carriers.

In an embodiment, the maintenance structure is movable parallel to the arrangement direction of the substrate-holder carriers.

In an embodiment, the maintenance structure has a wheel which allows the maintenance structure to move parallel to the arrangement direction of the substrate-holder carriers.

In an embodiment, the storage container has a door facing the maintenance area, and a locking mechanism is attached to the door.

In an embodiment, the plating apparatus further comprising: a detection sensor for detecting whether the substrate-holder carrier exists at a predetermined position on the storage container.

In an embodiment, the storage container includes a box in which the substrate holder is stored; and a bottom surface of the box has a slope shape.

Since the substrate-holder carrier is configured to be movable between the storage container and the maintenance area while supporting the substrate holder, the worker can conduct the maintenance of the substrate holder with a less load (a less load in terms of time and work) in the maintenance area in the apparatus.

Moreover, the collision between the worker and the transport machine can be avoided during the maintenance of the substrate holder. As a result, the worker can conduct the maintenance of the substrate holder while the plating apparatus is operating.

DESCRIPTION OF EMBODIMENTS

Figure 1:
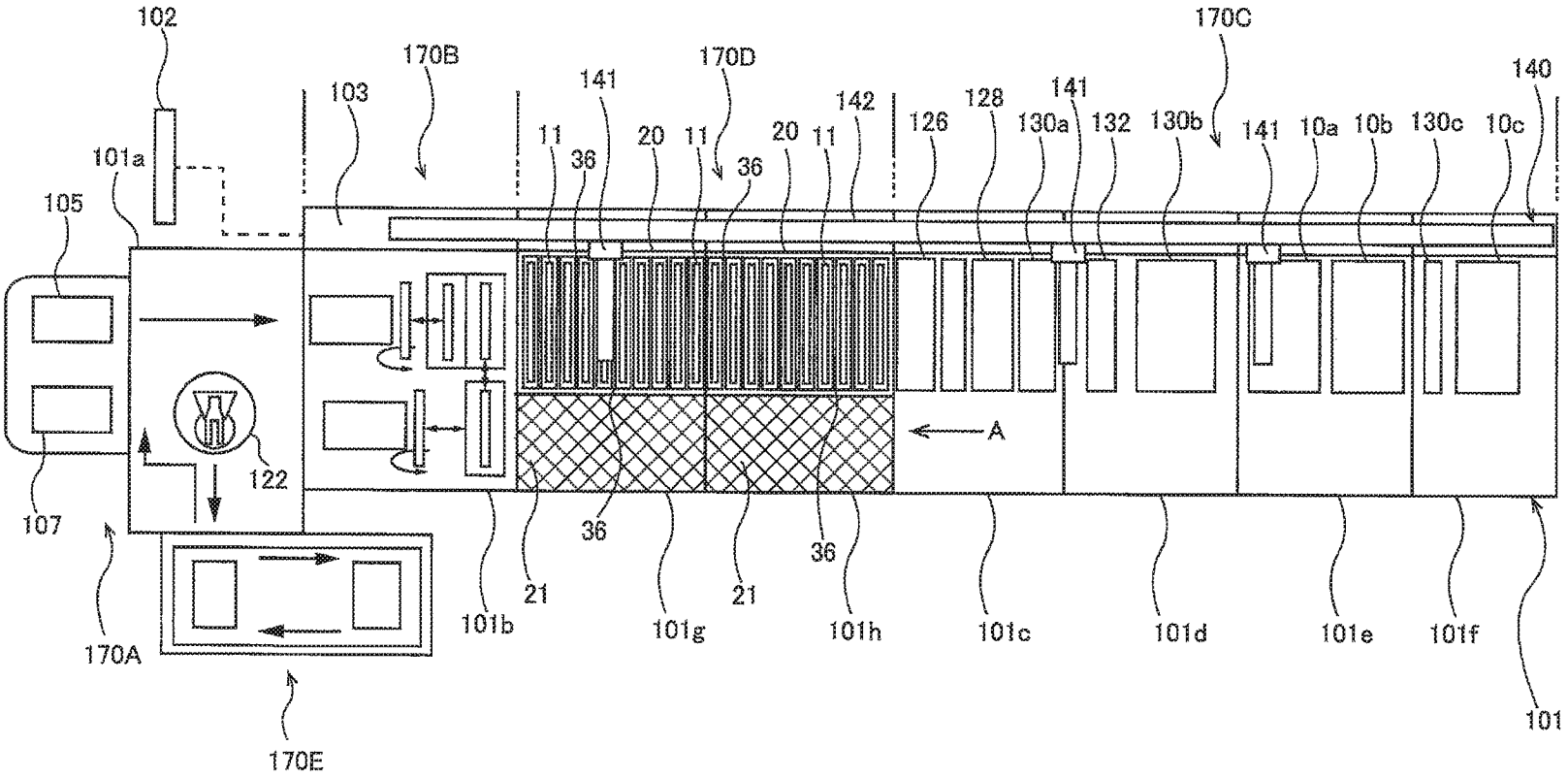
FIG. 1 is a schematic view showing an embodiment of a plating apparatus.

Embodiments will be described below with reference to the drawings. In the drawings described below, identical or corresponding components will be denoted by identical reference numerals, and repetitive descriptions thereof are omitted.

Figure 2:
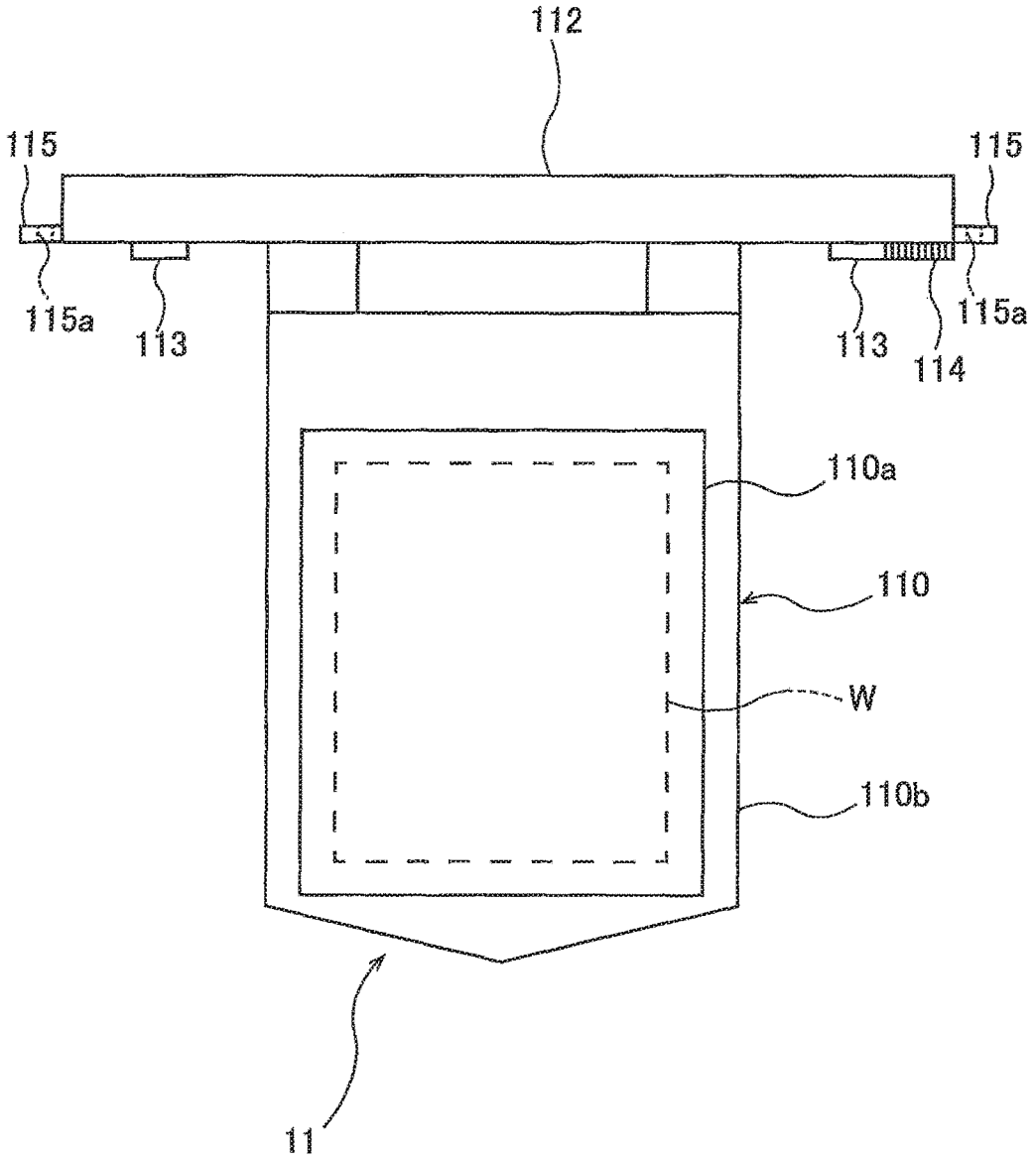
FIG. 2 is a schematic view showing an example of a substrate holder used in the plating apparatus according to the embodiment.

FIG. 1 is a schematic view showing an embodiment of a plating apparatus. FIG. 2 is a schematic view showing an example of a substrate holder used in the plating apparatus according to the embodiment. As shown in FIG. 1, the plating apparatus includes a pedestal 101, a controller 103 for controlling an operation of the plating apparatus, a load/unload section 170A for loading and unloading a substrate W (see FIG. 2), a substrate-setting section (or a mechanical room) 170B for setting the substrate W on a substrate holder 11 (see FIG. 2) and removing the substrate W from the substrate holder 11, a processing section (including a pretreatment room and a plating room) 170C for plating the substrate W, a holder storage section (or a stocker room) 170D for storing the substrate holder 11, and a cleaning section 170E for cleaning and drying a plated substrate W. The plating apparatus according to the embodiment is an electrolytic plating apparatus for plating a surface (surface to be plated) of the substrate W with a metal by passing an electrical current to a plating solution.

As shown in FIG. 1, the pedestal 101 includes a plurality of pedestal members 101*a* to 101*h*. These pedestal members 101*a* to 101*h* are configured to be able to be coupled to each other. Elements of the load/unload section 170A are arranged on a first pedestal member 101*a*, elements of the substrate-setting section 170B are arranged on a second pedestal member 101*b*, elements of the processing section 170C are arranged on a third pedestal member 101*c* to a sixth pedestal member 101*f*, and elements of the holder storage section 170D are arranged on a seventh pedestal member 101*g* and an eighth pedestal member 101*h*.

A loading stage 105 and an unloading stage 107 are provided in the load/unload section 170A. A cassette (not shown), which houses the substrate W to be plated, is mounted to the loading stage 105. A cassette (not shown) for receiving the substrate W that has been plated in the processing section 170C is mounted to the unloading stage 107. Further, a substrate transport device 122, which is constituted by a transport robot for transporting the substrate W, is arranged in the load/unload section 170A.

The substrate transport device 122 is configured to access the cassette mounted to the loading stage 105, to take the substrate, to be plated, out of the cassette, and to transfer the substrate W to the substrate-setting section 170B. The substrate W, to be plated, is set on the substrate holder 11, and the substrate W that has been plated is removed from the substrate holder 11 in the substrate-setting section 170B.

A pre-wetting tank 126, a pre-soaking tank 128, a first rinsing tank 130*a*, a blow tank 132, a second rinsing tank 130*b*, a first plating tank 10*a*, a second plating tank 10*b*, a third rinsing tank 130*c*, and a third plating tank 10*c* are located in the processing section 170C. These tanks 126, 128, 130*a*, 132, 130*b*, 10*a*, 10*b*, 130*c*, 10*c* are arranged in this order.

In the pre-wetting tank 126, as a preparation for pretreatment, the substrate W is immersed in pure water. In the pre-soaking tank 128, an oxide film on a surface of a conductive layer, such as a seed layer formed on the surface of the substrate W, is etched away by a chemical liquid. In the first rinsing tank 130*a*, the substrate W that has been pre-soaked is cleaned with a cleaning liquid (e.g., pure water).

The surface of the substrate W is plated in the first plating tank 10*a* or the second plating tank 10*b*. In this embodiment, the same type of plating solution is held in the first plating tank 10*a* and the second plating tank 10*b*. The substrate W is immersed in the plating solution held in the first plating tank 10*a* or the plating solution held in the second plating tank 10*b*, so that the surface of the substrate W is plated. A plating solution of the same type as the plating solutions held in the plating tanks 10*a*, 10*b* may be held in the third plating tank 10*c*. A plating solution of a different type from the plating solutions held in the plating tanks 10*a*, 10*b* may be held in the plating tank 10*c*.

In a case where the plating solution held in the third plating tank 10*c* is the same type as the plating solutions held in the plating tanks 10*a*, 10*b*, the substrate W that has been cleaned in the first rinsing tank 130*a* may be immersed in the plating solution held in the third plating tank 10*c* so that the surface of the substrate W is plated. In a case where the plating solution held in the third plating tank 10*c* is a different type from the plating solutions held in the plating tanks 10*a*, 10*b*, the substrate W that has been plated in the first plating tank 10*a* or the second plating tank 10*b* may be immersed in the plating solution held in the third plating tank 10*c* so that the surface of the substrate W is plated.

In the second rinsing tank 130*b*, the substrate holder 11 and the substrate W that has been plated in the first plating tank 10*a* or the second plating tank 10*b* are cleaned with a cleaning liquid (e.g., pure water). In the third rinsing tank

130*c*, the substrate holder 11 and the substrate W that has been plated in the third plating tank 10*c* are cleaned with a cleaning liquid (e.g., pure water). In the blow tank 132, the cleaning liquid is removed from the substrate W that has been cleaned. The third plating tank 10*c* and the third rinsing tank 130*c* are not indispensable elements, and may be provided as necessary.

The pre-wetting tank 126, the pre-soaking tank 128, the rinsing tanks 130*a* to 130*c*, and the plating tanks 10*a* to 10*c* are processing tanks capable of holding a processing liquid (or a liquid) therein. Each of these processing tanks includes a plurality of processing cells each for holding a processing liquid, while the processing tanks are not limited to this embodiment. Each of these processing tanks may include a single processing cell. At least one of these processing tanks may include a single processing cell, while other processing tanks may each include processing cells.

The plating apparatus further includes a transport machine 140 for transporting the substrate holder 11. The transport machine 140 is configured to be movable between elements of the plating apparatus. The transport machine 140 includes a fixed base 142 which extends horizontally from the substrate-setting section 170B to the processing section 170C, and a plurality of transporters 141 which are configured to be movable along the fixed base 142.

Each of these transporters 141 has a movable portion (not shown) for holding the substrate holder 11, and is configured to hold the substrate holder 11. The transporter 141 transports the substrate holder 11 between the substrate-setting section 170B, the holder storage section 170D, and the processing section 170C. The transporter 141 is further configured to vertically move the substrate holder 11 together with the substrate W. A moving mechanism of the transporter 141 may include a combination of a motor and a rack and pinion. In this embodiment, three transporters are provided, while the number of transporters is not limited to the embodiment.

A structure of the substrate holder 11 will be described with reference to FIG. 2. As shown in FIG. 2, the substrate holder 11 includes a main body 110 by which the substrate W is held, and an arm portion 112 provided on an upper end of the main body 110. The main body 110 includes a first member 110*a* and a second member 110*b*. The substrate W is sandwiched between the first member 110*a* and the second member 110*b*, so that the substrate holder 11 can hold the substrate W. The substrate holder 11 is transported with its arm portion 112 held by the transporter 141.

The substrate holder 11 can be changed from a vertical position to a horizontal position or from a horizontal position to a vertical position by a mechanism (not shown) in the substrate-setting section 170B. For example, the substrate W is placed on the first member 110*a* of the substrate holder 11, and then the first member 110*a* fixes the substrate W thereto. Thereafter, the first member 110*a* is changed from the horizontal position to the vertical position. The first member 110*a*, with the substrate W fixed thereto, comes close to the second member 110*b* of the substrate holder 11 waiting in a fixed vertical position, until the substrate W is sandwiched between the first member 110*a* and the second member 110*b*, whereby the substrate W is held by the substrate holder 11.

The substrate holder 11 seals a periphery of the substrate W so that the plating solution does not contact the periphery and a back surface of the substrate W, while holding the substrate W with its front surface exposed through the substrate holder 11. In this embodiment, the substrate W has a quadrilateral shape, while the shape of the substrate W is not limited to this embodiment. For example, the substrate W may have a round shape.

When the substrate W, held by the substrate holder 11, is immersed in the processing solution held in each of the processing tanks, the arm portion 112 is placed on arm receiving members (not shown) of each of the processing tanks. More specifically, two projecting portions 113 are provided on a lower surface of the arm portion 112, and these projecting portions 113 are placed on the arm receiving members. The projecting portion 113 is a portion that supports a self-weight of the substrate holder 11 when the substrate holder 11 is set on the processing tank. In this embodiment, the plating tanks 10*a* to 10*c* are electrolytic plating tanks. Therefore, when a power supply contact (or a connector portion) 114 fixed to the arm portion 112 makes contact with an electrical contact (not shown) provided on the arm receiving members, an electrical current is supplied from an external power supply to the surface of the substrate W.

The plated substrate W, together with the substrate holder 11, is transported to the substrate-setting section 170B by the transporter 141, and the plated substrate W is then removed from the substrate holder 11 in the substrate-setting section 170B. This substrate W is transported to the cleaning section 170E by the substrate transport device 122, and is then cleaned and dried in the cleaning section 170E. Thereafter, the substrate W is returned to the cassette mounted to the unloading stage 107 by the substrate transport device 122.

The holder storage section 170D will be described. As shown in FIG. 1, the holder storage section 170D is located between the substrate-setting section 170B and the processing section 170C. The load/unload section 170A, the substrate-setting section 170B, the holder storage section 170D, and the processing section 170C are arranged in this order. Storage containers 20 for storing the substrate holder 11 for holding the substrate W and maintenance areas 21 adjacent to the storage containers 20 are arranged in the holder storage section 170D. Shaded regions in FIG. 1 represent the maintenance areas 21.

Figure 3:
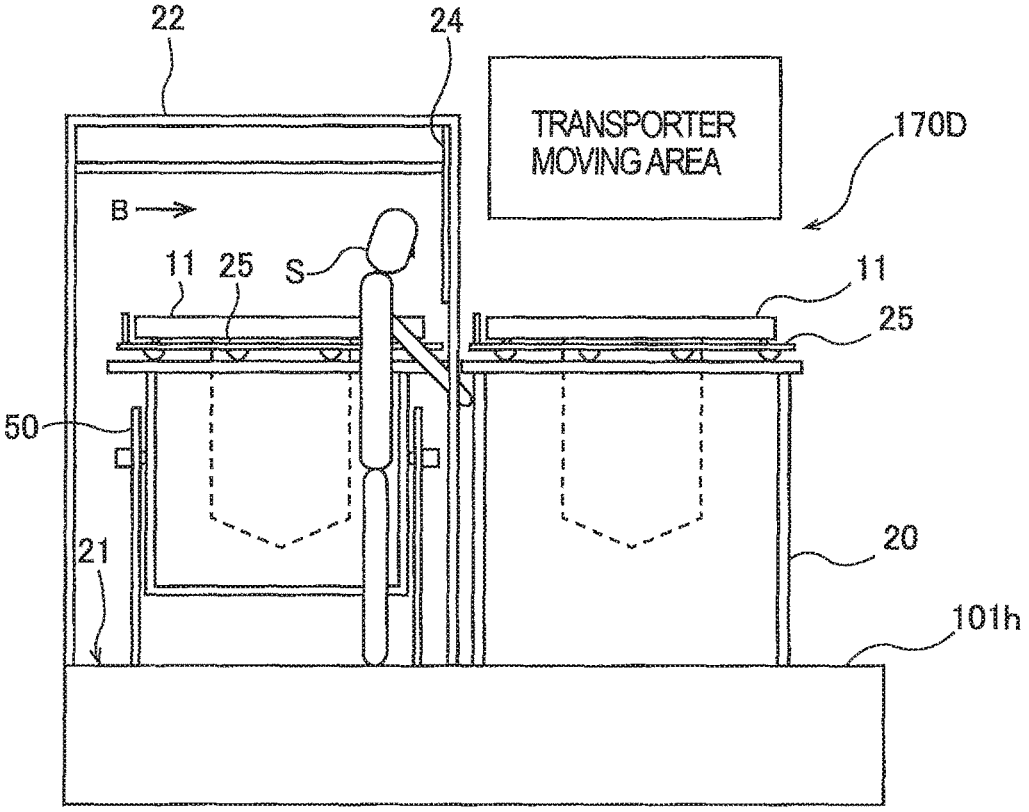
FIG. 3 is a view from a direction indicated by arrow A in FIG. 1.

FIG. 3 is a view from a direction indicated by arrow A in FIG. 1. The maintenance areas 21, adjacent to the storage containers 20, are located above the pedestal 101 (more specifically, above the pedestal members 101*g*, 101*h*). Each maintenance area 21 has a size that a worker S can conduct maintenance of the substrate holder 11 in the maintenance area 21. The storage containers 20 and the maintenance areas 21 are arranged in parallel, and are adjacent to each other. Further, the maintenance areas 21 are also adjacent to the outside of the plating apparatus. Therefore, the worker S can easily enter the maintenance area 21, and can easily access the storage container 20 from the maintenance area 21.

As shown in FIG. 3, the plating apparatus further includes a substrate-holder carrier 25 supported by the storage container 20. The substrate holder 11 is mounted to the substrate-holder carrier 25, and the substrate-holder carrier 25 is supported by the storage container 20. The substrate-holder carrier 25 is configured to be movable between the storage container 20 and the maintenance area 21 while supporting the substrate holder 11. Structures of the storage container 20 and the substrate-holder carrier 25 will be described later.

Figure 4:
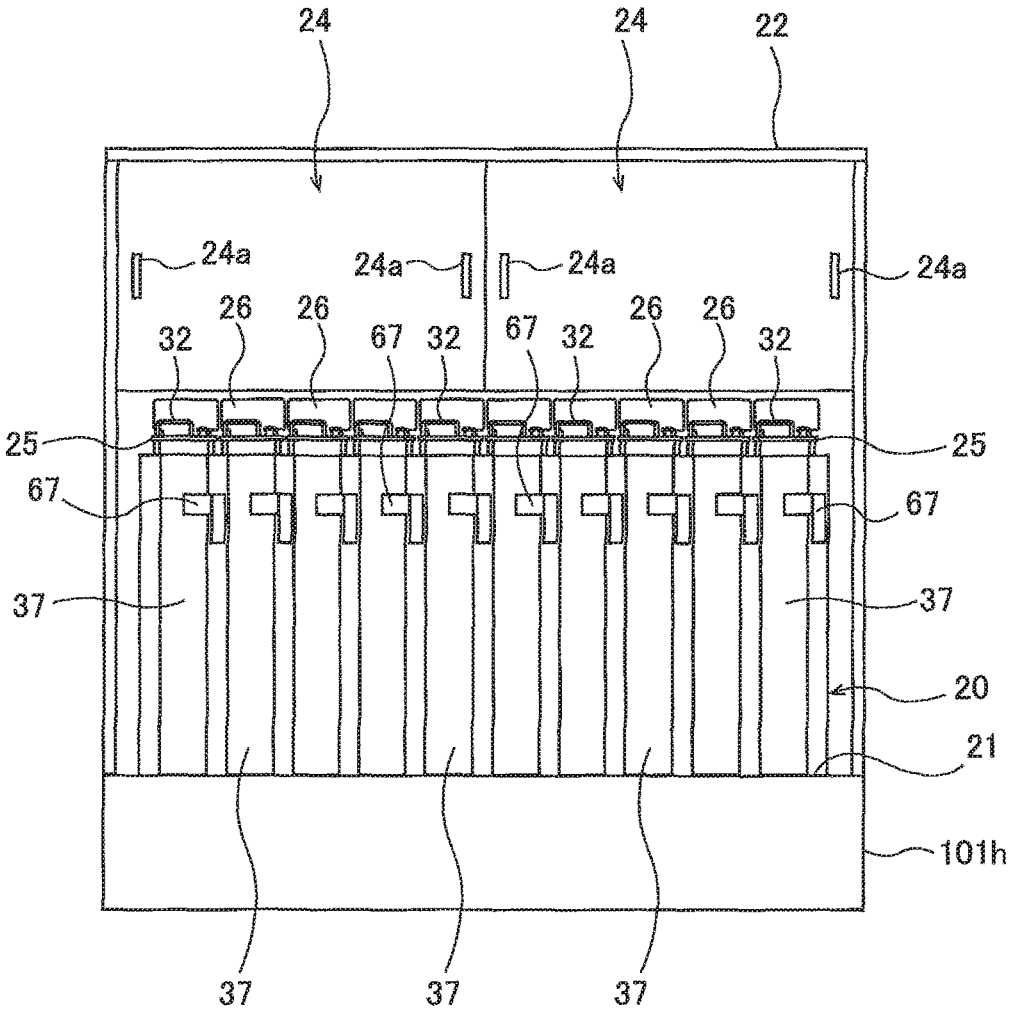
FIG. 4 is a view from a direction indicated by arrow B in FIG. 3.

FIG. 4 is a view from a direction indicated by arrow B in FIG. 3. In FIG. 4, only main elements are illustrated, and a part of the holder storage section 170D is illustrated. As shown in FIG. 4, the holder storage section 170D includes partitions (safety covers) 24 arranged between the maintenance area 21 and the storage container 20. The partitions 24 are located higher than the storage container 20. More specifically, a frame 22 is provided in the maintenance area 21, and the partitions 24 are attached to an upper part of the frame 22. The number of partitions 24 is not limited to this embodiment.

Since the holder storage section 170D of the plating apparatus includes the partitions 24, the partitions 24 can prevent the worker S from accidentally accessing the substrate holder 11 through a space above the storage container 20. Therefore, the partitions 24 can avoid the worker S from touching the transporter 141 (or the substrate holder 11) that is moving above the storage container 20.

Knobs 24*a* for removing each partition 24 are attached to the partition 24. In order to ensure safety of the worker S, the partitions 24 are secured to the frame 22 such that the partitions 24 cannot be easily removed. In this embodiment, a sensor (not shown) is attached to the partition 24. If the partition 24 is removed during operation of the apparatus, the transport machine 140 is forced to stop.

As shown in FIG. 4, a plurality of substrate-holder carriers 25 are arranged in the storage container 20 along an extending direction of the maintenance areas 21. In other words, the maintenance areas 21 extend in parallel to an arrangement direction of the substrate-holder carriers 25. Guards 26 for preventing a collision between the worker S and the transporter 141 (or the substrate holder 11) are secured to the substrate-holder carriers 25, respectively.

The storage container 20 includes doors 37 facing the maintenance areas 21. Locking mechanisms 67 are attached to the doors 37, respectively, so that the doors 37 are not able to easily be removed. In this embodiment, each of the locking mechanism 67 is an automatic lock mechanism (e.g., an electromagnetic lock mechanism).

When maintenance of the substrate holder 11 is not necessary, in order to restrict the access of the worker S to the substrate holder 11, the door 37 is locked by the locking mechanism 67. In a case where maintenance of the substrate holder 11 is necessary, the worker S unlocks the door 37 after the locking mechanism 67 becomes unlockable, and then removes the door 37. In this manner, the worker S can access the substrate holder 11. The case where maintenance of the substrate holder 11 is necessary means a case where the substrate W is not properly set on the substrate holder 11, for example.

In one embodiment, in the case where maintenance of the substrate holder 11 is necessary, a signal for unlocking the door 37 is generated by the controller 103, and then a signal for setting the locking mechanism 67 to an unlocking mode is inputted, so that the locking mechanism 67 can be unlocked. Further, the worker S may operate a display screen of an operation device 102 (see FIG. 1) for unlocking the door 37 so as to unlock the door 37. For example, the operation device 102 is an operation device having an operation screen of touch panel type, and is connected to the controller 103.

In another embodiment, in a case where maintenance of the substrate holder 11 is necessary, a signal for unlocking the door 37 is generated by the controller 103, and then the signal for setting the locking mechanism 67 to the unlocking mode is inputted, so that the locking mechanism 67 can be unlocked. Further, the controller 103 generates a signal for unlocking the door 37. This signal is then inputted to an unlocking mechanism (not shown) of the door 37, so that the unlocking mechanism is activated to unlock the door 37.

In still another embodiment, in the case where maintenance of the substrate holder 11 is necessary, the worker S operates the screen of the operation device 102 so as to push a button for setting the locking mechanism 67 to the unlocking mode. Such an unlocking signal inputted by the worker S is inputted to the controller 103, a signal for unlocking the door 37 is generated in the controller 103, and a signal for setting the locking mechanism 67 to the unlocking mode is inputted, so that the locking mechanism 67 can be unlocked. The worker S may operate the screen of the operation device 102 for unlocking the door 37 so that the door 37 is unlocked.

The worker S removes the door 37 after unlocking the door 37, and moves the substrate-holder carrier 25, supporting the substrate holder 11, from the storage container 20 to the maintenance area 21 (i.e., to a maintenance structure 50 shown in FIG. 3). Thereafter, the worker S conducts the maintenance of the substrate holder 11 in the maintenance area 21. Details of the maintenance structure 50 will be described later.

Figure 5:
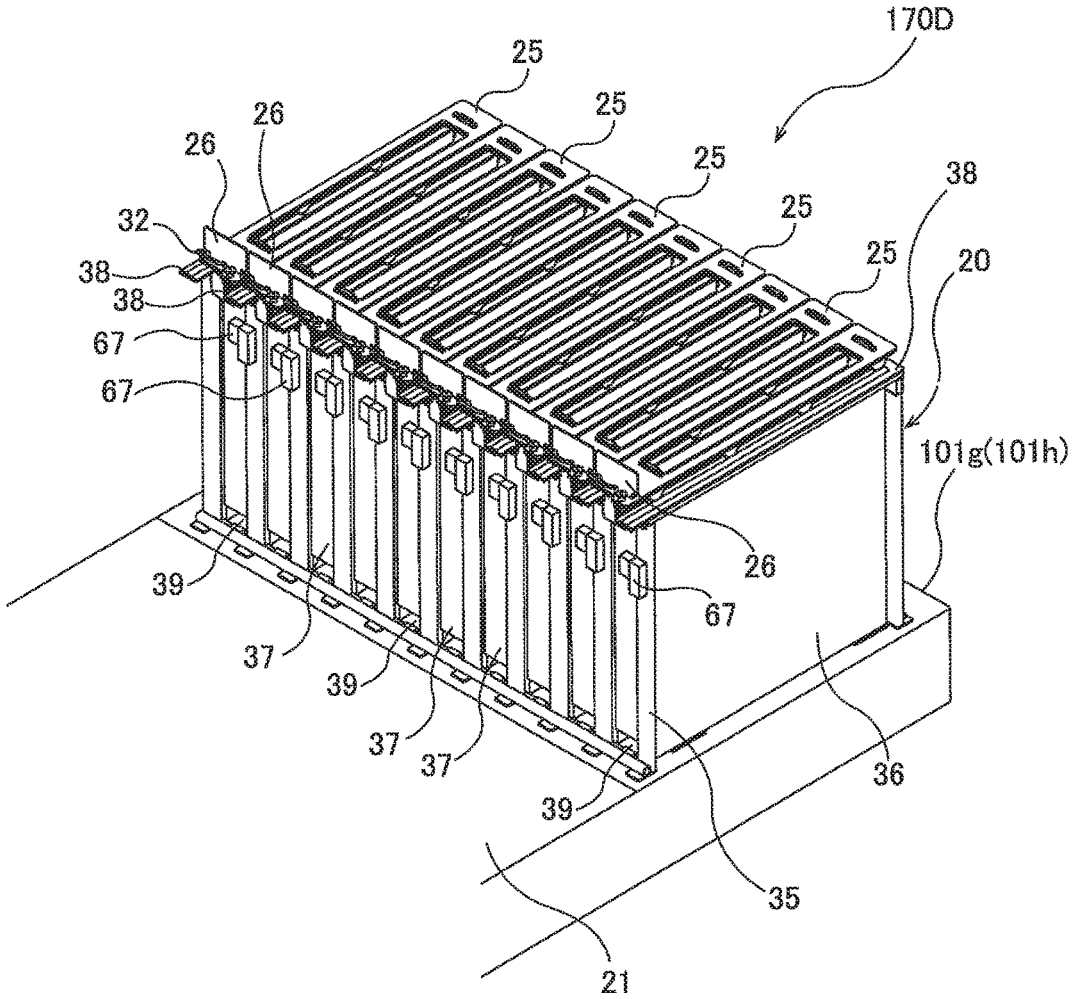
FIG. 5 is a perspective view showing a storage container and a substrate-holder carrier.

Structures of the storage container 20 and the substrate-holder carrier 25 will be described. FIG. 5 is a perspective view showing the storage container 20 and the substrate-holder carrier 25. In FIG. 5, depiction of the substrate holder 11 is omitted, and a part of the holder storage section 170D is illustrated. As shown in FIG. 5, the substrate-holder carriers 25 are supported by the storage container 20.

The storage container 20 includes boxes 36, which constitute walls and a bottom of the storage container 20, and a container frame 35 arranged so as to cover the boxes 36. The container frame 35 is made of a rigid material (e.g., metal), and extends along a longitudinal direction of the pedestal 101. A plurality of first guide rails 38, by which the substrate-holder carriers 25 are supported, are arranged on the container frame 35. The first guide rails 38 may be integral with the container frame 35. Each of the first guide rails 38 extends parallel to a width direction of the pedestal 101. The longitudinal direction of the pedestal 101 is defined as a direction parallel to an arrangement direction of the load/unload section 170A, the substrate-setting section 170B, the holder storage section 170D, and the processing section 170C. The width direction of the pedestal 101 is defined as a direction perpendicular to the longitudinal direction of the pedestal 101.

Each of the boxes 36 is configured to house the substrate holder 11 therein. The processing liquid (or a liquid) may adhere to the substrate holder 11, and such processing liquid may drop onto the box 36. Therefore, the boxes 36 are made of material (e.g., resin) having a resistance to the processing liquid. Each box 36 is divided into a plurality of spaces by at least one partition plate (not shown), and the substrate holders 11 are disposed in the spaces, respectively.

In this embodiment, the storage container 20 includes a plurality of (five) boxes 36, and an inside of each box 36 is divided by one partition plate. As shown in FIG. 1, since two storage containers 20 are provided in the holder storage section 170D, a total of ten boxes 36 are provided in the holder storage section 170D. Therefore, twenty substrate holders 11 can be stored in the holder storage section 170D. However, the number of storage containers 20 and the number of boxes 26 are not limited to this embodiment. The number of storage containers 20 and the number of boxes 36 may be changed in accordance with an operation condition of the plating apparatus.

In one embodiment, the storage container 20 may include the same number of boxes 36 as the number of substrate holders 11 to be stored. For example, in a case where twenty substrate holders 11 are to be stored in the holder storage section 170D, twenty boxes 36 are provided in the holder storage section 170D. In another embodiment, the storage container 20 may include only one box 36, and a plurality of substrate holders 11 may be stored in this box 36.

Figure 6:
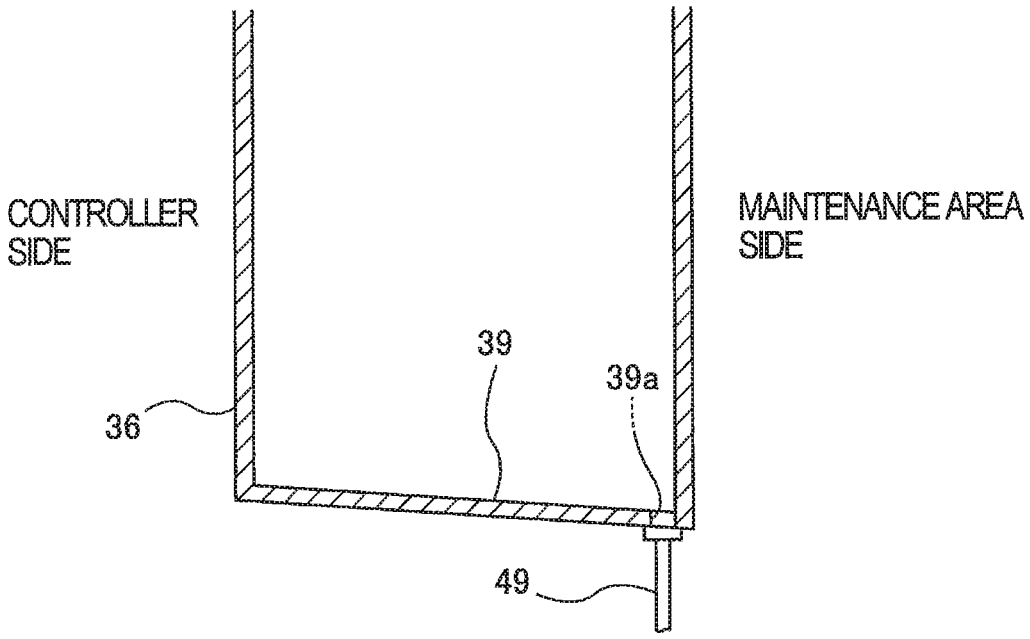
FIG. 6 is a view showing a bottom surface of a box.

FIG. 6 is a view showing a bottom surface 39 of the box 36. As shown in FIG. 6, the bottom surface 39 of the box 36 has a slope shape. More specifically, the bottom surface 39 of the box 36 is a slope surface which is inclined downwardly from the controller-103-side toward the maintenance-area-21-side. An opening 39*a* is formed in the lowest position of the bottom surface 39, and a drain line 49 is connected to the opening 39*a*. Therefore, when the processing liquid which adheres to the substrate holder 11 drops into the box 36, the processing liquid flows down on the bottom surface 39 of the box 36, and is then expelled through the opening 39*a* and the drain line 49. An angle of inclination of the bottom surface 39 is such that the substrate holder 11 does not contact the bottom surface 39 when the substrate holder 11 is housed in the box 36.

Figure 7:
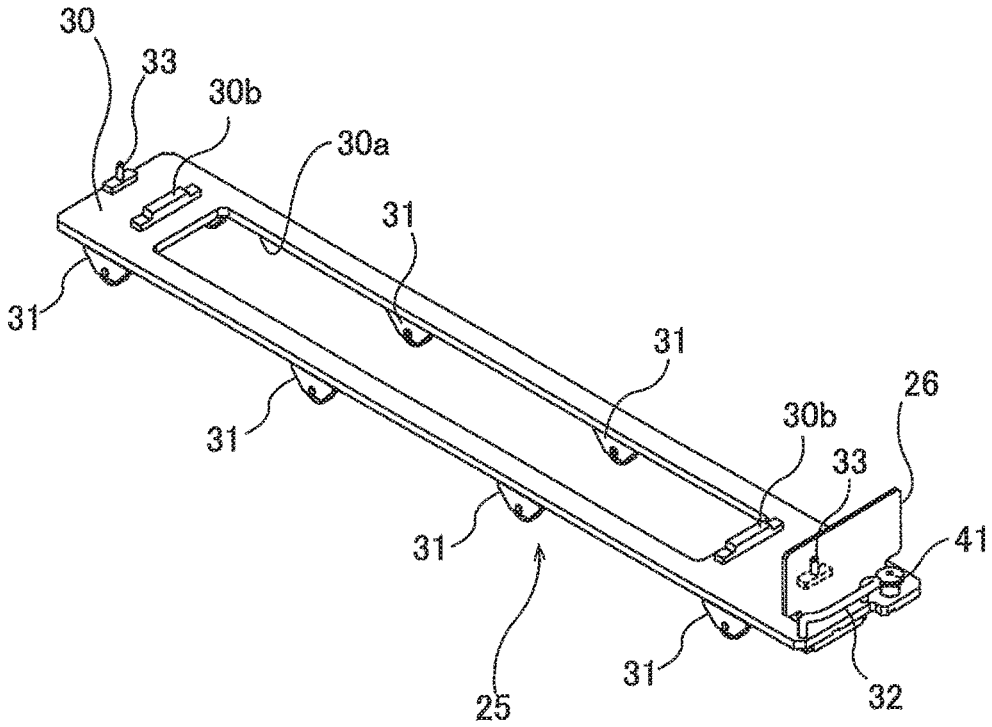
FIG. 7 is a perspective view showing the substrate-holder carrier.

The substrate-holder carrier 25 will be described below with reference to FIG. 7. FIG. 7 is a perspective view showing the substrate-holder carrier 25. The substrate-holder carrier 25 includes a rectangular base 30 on which the substrate holder 11 is placed, and a plurality of rolling elements 31 attached to the base 30. The base 30 has an opening 30*a* at a center of the base 30 and has holder receiving portions 30*b* on which the substrate holder 11 (more specifically, the projecting portions 113 of the substrate holder 11) is supported.

The rolling elements 31 are attached to a lower surface of the base 30, and are in contact with the first guide rail 38 of the storage container 20. Each rolling element 31 may be a wheel which is constituted by a roller and a holder for rotatably holding the roller. In this embodiment, eight rolling elements 31 are provided, while the number of rolling elements 31 is not limited to this embodiment. A handle 32 is attached to the maintenance-area-21-side of the base 30 so that the worker S can move the substrate-holder carrier 25 by grasping the handle 32.

Holder positioning members (or positioning pins) 33 for fixing a position of the substrate holder 11 are attached to an upper surface of the base 30 of the substrate-holder carrier 25. Positioners 115 (see FIG. 2) are provided on both sides of the arm portion 112 of the substrate holder 11. Positioning holes 115*a* (see FIG. 2), into which the holder positioning members 33 are to be inserted, are formed in the positioners 115, respectively. When the holder positioning members 33 are inserted into the positioning holes 115*a* of the positioner 115, a relative position of the substrate holder 11 and the substrate-holder carrier 25 is fixed.

The opening 30*a* has a size that the substrate holder 11 can be inserted therein. The holder receiving portions 30*b* are secured to the base 30 at both sides of the opening 30*a*. The transporter 141 transports the substrate holder 11 to a predetermined position above the substrate-holder carrier 25, and then lowers the substrate holder 11. The main body 110 of the substrate holder 11 is inserted into the storage container 20 (more specifically, into the box 36) through the opening 30*a* of the substrate-holder carrier 25, until the holder positioning members 33 of the substrate-holder carrier 25 are inserted into the positioning holes 115*a* of the positioners 115. In this manner, the substrate holder 11 is housed in the storage container 20 in a state in which the substrate holder 11 is supported by the substrate-holder carrier 25 in the vertical position, and the relative position with respect to the substrate-holder carrier 25 is fixed.

Figure 8:
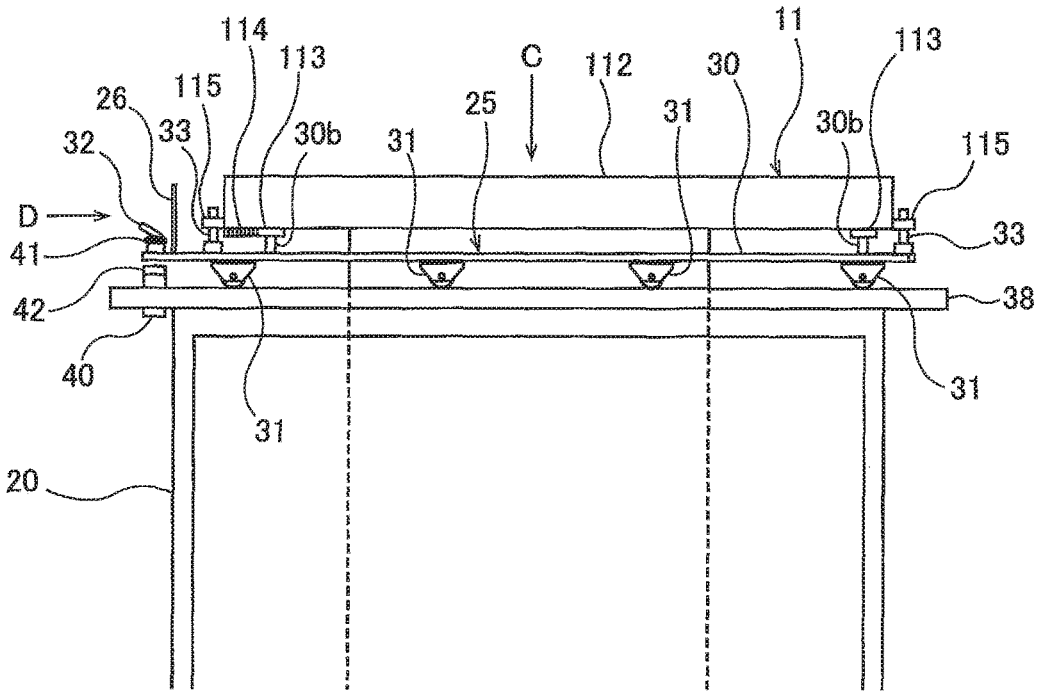
FIG. 8 is a view showing the substrate-holder carrier supported by the storage container, and showing the substrate holder supported by the substrate-holder carrier.
Figure 9:
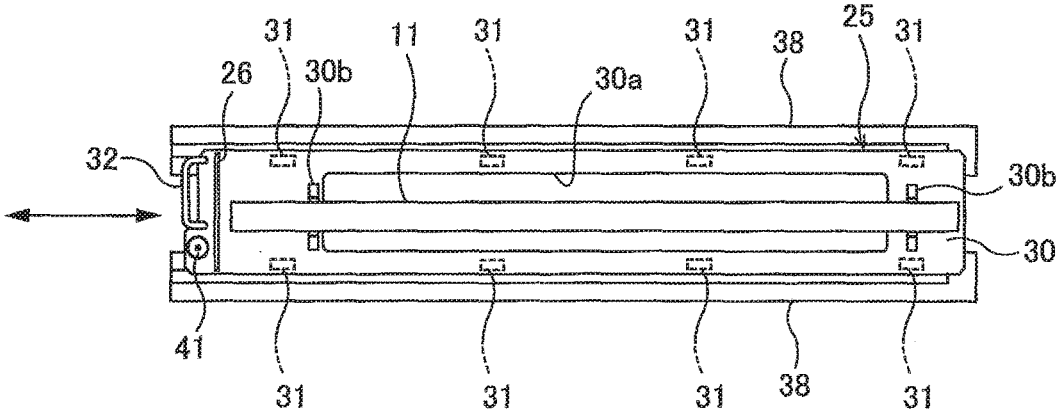
FIG. 9 is a view from a direction indicated by arrow C in FIG. 8.
Figure 10:
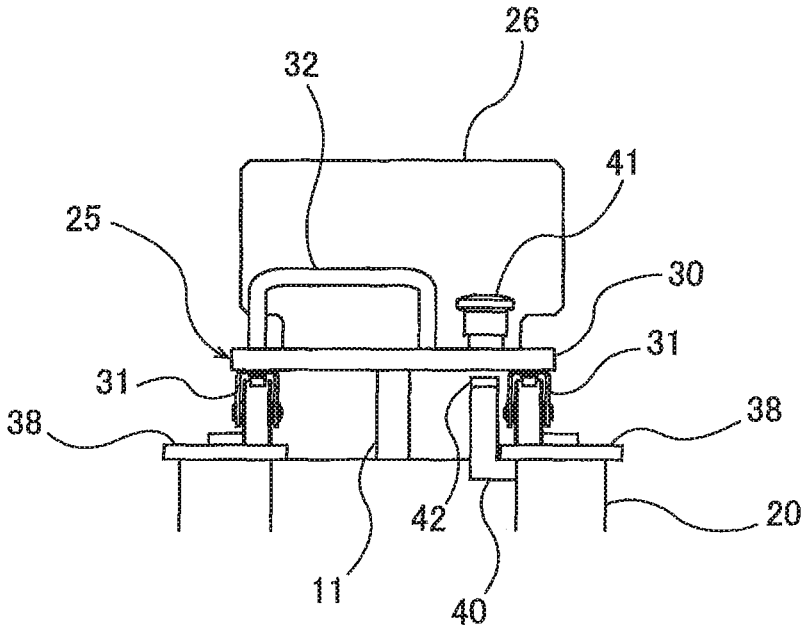
FIG. 10 is a view from a direction indicated by arrow D in FIG. 8.

FIG. 8 is a view showing the substrate-holder carrier 25 supported by the storage container 20 and showing the substrate holder 11 supported by the substrate-holder carrier 25. FIG. 9 is a view from a direction indicated by arrow C in FIG. 8. FIG. 10 is a view from a direction indicated by arrow D in FIG. 8. The substrate-holder carrier 25 is placed on the first guide rails 38, and is movable along an extending direction of the first guide rails 38 (see arrow in FIG. 9) while supporting the substrate holder 11. The storage container 20 is supported by the pedestal 101 (more specifically, the pedestal members 101*g*, 101*h*). The substrate-holder carrier 25 is movable independently of the storage container 20. Therefore, the substrate-holder carrier 25 (and the substrate holder 11) can be moved between the storage container 20 and the maintenance area 21 (more specifically, between the storage container 20 and the maintenance structure 50) without moving the storage container 20.

As shown in FIG. 8, when the substrate holder 11 is supported by the substrate-holder carrier 25, the holder receiving portions 30*b* have a height that the power supply contact 114 does not contact the base 30 of the substrate-holder carrier 25. The holder receiving portions 30*b* can prevent the power supply contact 114 from touching the base 30. As a result, the holder receiving portions 30*b* can prevent a foreign matter from adhering to the power supply contact 114. A total height of the holder receiving portion 30*b* and the projecting portion 113 may be a height that the power supply contact 114 does not touch the base 30.

As shown in FIGS. 8 to 10, one substrate holder 11 is supported by one substrate-holder carrier 25. The substrate-holder carriers 25 are supported by the storage container 20, and are individually movable. Therefore, a certain substrate holder 11, which is an object of maintenance, can be moved from the storage container 20 to the maintenance area 21 (more specifically, to the maintenance structure 50), while allowing another substrate holder 11, which is not an object of maintenance, to remain in the storage container 20.

Figure 11:
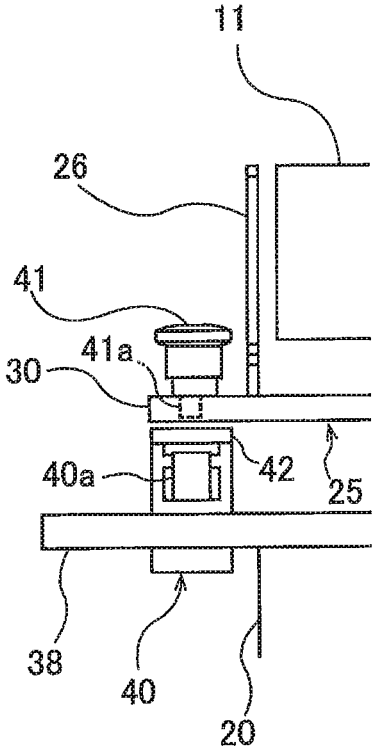
FIG. 11 is a view showing a detection sensor secured to the storage container.
Figure 12:
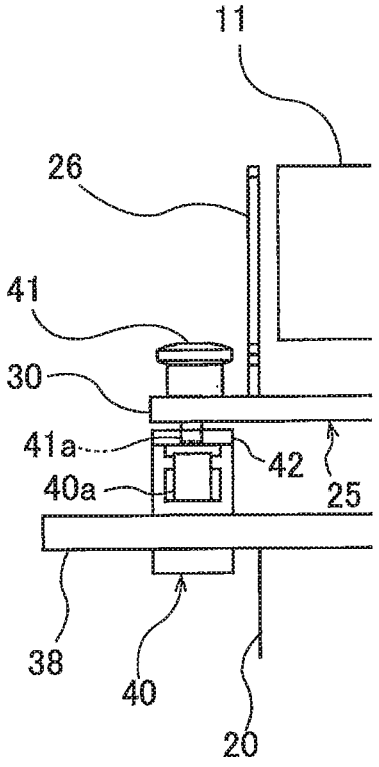
FIG. 12 is a view showing the detection sensor secured to the storage container.

A detection sensor 40 for detecting whether the substrate-holder carrier 25 exists at a predetermined position on the storage container 20 will be described with reference to FIG. 11 and FIG. 12. FIG. 11 and FIG. 12 are views showing the detection sensor 40 secured to the storage container 20. In FIG. 11 and FIG. 12, depiction of the handle 32 is omitted for the purpose of making it easier to view the drawing.

As described above, since the substrate-holder carrier 25 is configured to be movable independently of the storage container 20, the substrate-holder carrier 25 may be moved to the maintenance area 21 (more specifically, to the maintenance structure 50) during operation of the plating apparatus, and may not exist at a predetermined position on the storage container 20. Therefore, the detection sensor 40 is provided for detecting whether the substrate-holder carrier 25 exists at a predetermined position on the storage container 20 so that the controller 103 can recognize the substrate-holder carrier 25 existing at the predetermined position on the storage container 20.

The detection sensor 40 is configured to send a detection signal indicating that the substrate-holder carrier 25 exists on the storage container 20 to the controller 103. The controller 103 can determine that the substrate-holder carrier 25 exists at a predetermined position on the storage container 20 based on the detection signal sent from the detection sensor 40.

The detection sensor 40 is secured to the storage container 20 (more specifically, to the first guide rail 38). A sensing part 40*a* of the detection sensor 40 is located above the first guide rail 38. A detection pin 41 is secured to the base 30 of the substrate-holder carrier 25. In this embodiment, the detection sensor 40 is a reflective sensor which detects an existence or nonexistence of the substrate-holder carrier 25 in response to a distance between a distal end of a pin portion 41*a* of the detection pin 41 and the sensing part 40*a*.

When the worker S moves the substrate-holder carrier 25 to a predetermined position on the storage container 20 (see FIG. 11) and pushes the detection pin 41, the pin portion 41*a* of the detection pin 41 comes close to the sensing part 40*a* of the detection sensor 40 (see FIG. 12). As a result, the detection sensor 40 detects that the substrate-holder carrier 25 exists at a predetermined position on the storage container 20, and sends the detection signal to the controller 103, whereby the controller 103 recognizes the existence of the substrate-holder carrier 25. In one embodiment, the existence of the substrate-holder carrier 25 at a predetermined position on the storage container 20 is displayed on the operation screen of the operation device 102 (see FIG. 1).

A carrier positioning member 42 for determining (fixing) a relative position of the substrate-holder carrier 25 and the storage container 20 is provided above the detection sensor 40. A hole, into which the pin portion 41*a* of the detection pin 41 is inserted, is formed in the carrier positioning member 42. When the pin portion 41*a* of the detection pin 41 is inserted into the hole of the carrier positioning member 42, the relative position of the substrate-holder carrier 25, to which the pin portion 41*a* of the detection pin 41 is secured, and the storage container 20, to which the detection sensor 40 is secured, is fixed. In this embodiment, the relative position of the substrate-holder carrier 25 and the storage container 20 is fixed by pushing the detection pin 41, and the detection sensor 40 can detect the existence of the substrate-holder carrier 25.

Figure 13:
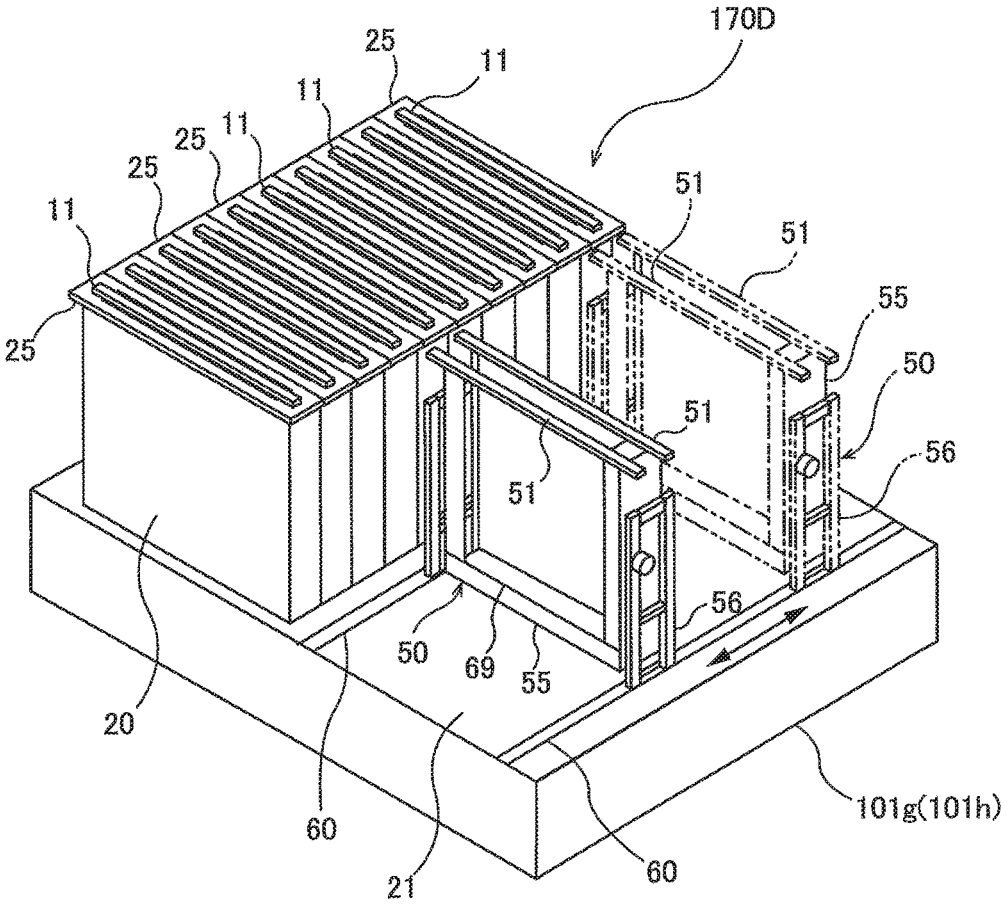
FIG. 13 is a perspective view showing a maintenance structure arranged in a maintenance area.
Figure 14:
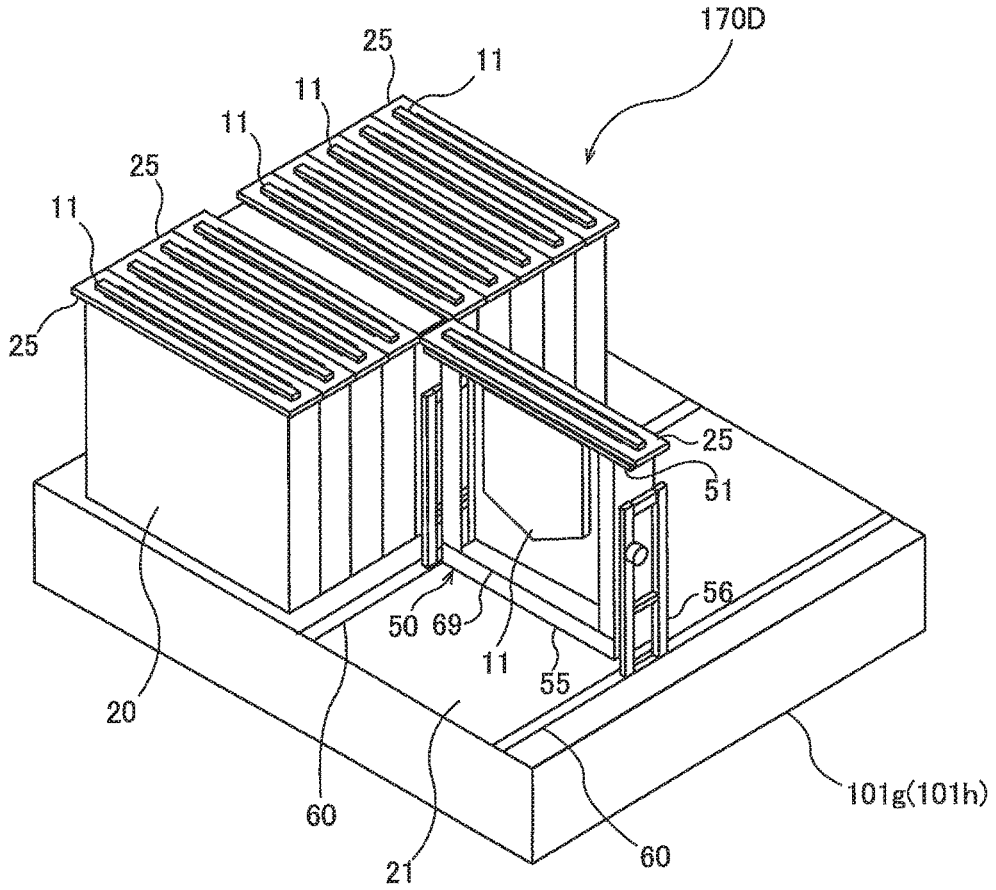
FIG. 14 is a perspective view showing the maintenance structure arranged in the maintenance area.
Figure 15:
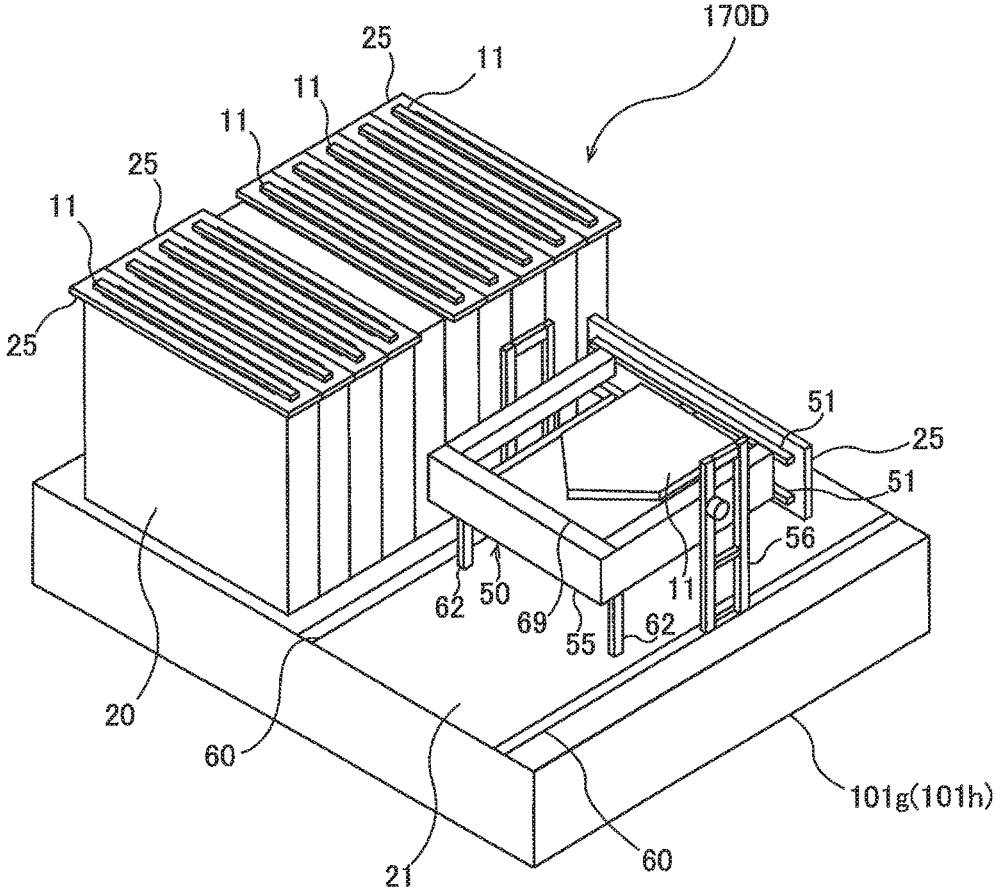
FIG. 15 is a perspective view showing the maintenance structure arranged in the maintenance area.

The maintenance structure 50 will be described with reference to the drawings. FIGS. 13 to 15 are perspective views showing the maintenance structure 50 arranged in the maintenance area 21. In FIGS. 13 to 15, the substrate holder 11, the storage container 20, the substrate-holder carrier 25, and the maintenance structure 50 are schematically illustrated, and a part of the holder storage section 170D is illustrated.

The maintenance structure 50 is configured to be able to receive the substrate holder 11 and the substrate-holder carrier 25. The maintenance structure 50 is located in the maintenance area 21, and is adjacent to the storage container 20. The maintenance structure 50 is supported by the pedestal 101 (more specifically, by the pedestal member 101*g* or the pedestal member 101*h*). Hereinafter, the pedestal members 101*g*, 101*h* may be collectively referred to as pedestal 101.

The maintenance structure 50 is movable in parallel to the arrangement direction of the substrate-holder carriers 25. More specifically, base guides 60 for guiding a movement of the maintenance structure 50 are provided on the pedestal 101. The base guides 60 extend parallel to the arrangement direction of the substrate-holder carriers 25, and the maintenance structure 50 can move along an extending direction of the base guides 60 (see FIG. 13). The base guides 60 in this embodiment are grooves formed in the pedestal 101, while the base guides 60 may be rails lying on the pedestal 101.

The maintenance structure 50 includes second guide rails 51 for supporting the rolling elements 31 (see FIG. 7) of the substrate-holder carrier 25, a work table 55 fixed to the second guide rails 51 and extends downwardly from the second guide rails 51, and support members 56 for rotatably supporting the work table 55. The second guide rails 51 are configured to be able to be aligned with the first guide rails 38. In other words, the second guide rails 51 extend parallel to the width direction of the pedestal 101 as with the first guide rails 38.

Figure 16:
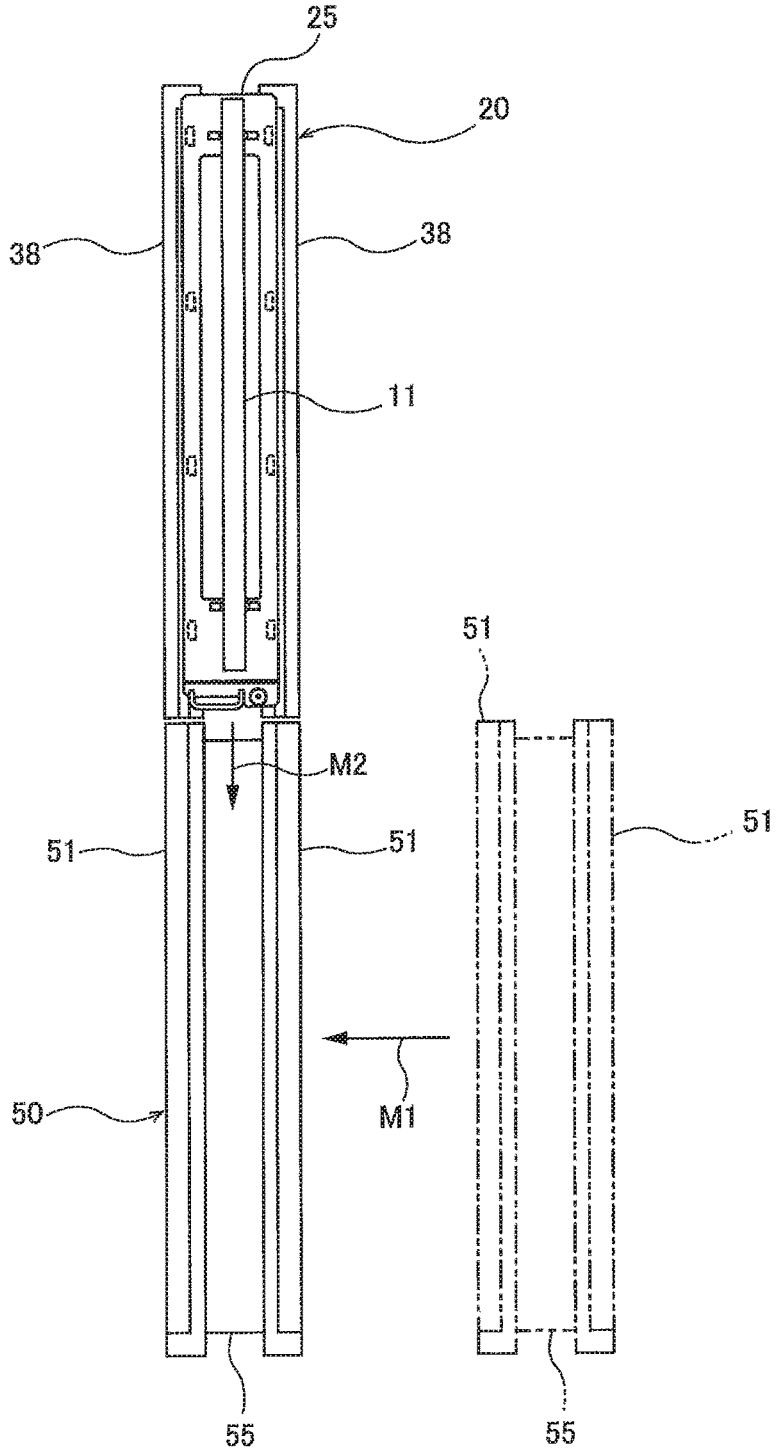
FIG. 16 is a view showing a second guide rail aligned with a first guide rail.

FIG. 16 is a view showing the second guide rails 51 aligned with the first guide rails 38. As shown in FIG. 16, the maintenance structure 50 is moved within the maintenance area 21 until the second guide rails 51 are aligned with the first guide rails 38 (see arrow M1 in FIG. 16). Since a slight gap is formed between the first guide rails 38 and the second guide rails 51, the second guide rails 51 does not contact the first guide rails 38 when the maintenance structure 50 is moved within the maintenance area 21.

The substrate-holder carrier 25, by which the substrate holder 11 is supported, is moved from the storage container 20 to the maintenance structure 50 when the second guide rails 51 are aligned with the first guide rails 38 (see arrow M2 in FIG. 16). As a result, as shown in FIG. 14, the substrate-holder carrier 25 supporting the substrate holder 11 thereon is supported by the maintenance structure 50 provided in the maintenance area 21. In this manner, the substrate-holder carrier 25 can move from the storage container 20 to the maintenance structure 50 in the maintenance area 21 while supporting the substrate holder 11.

Figure 17:
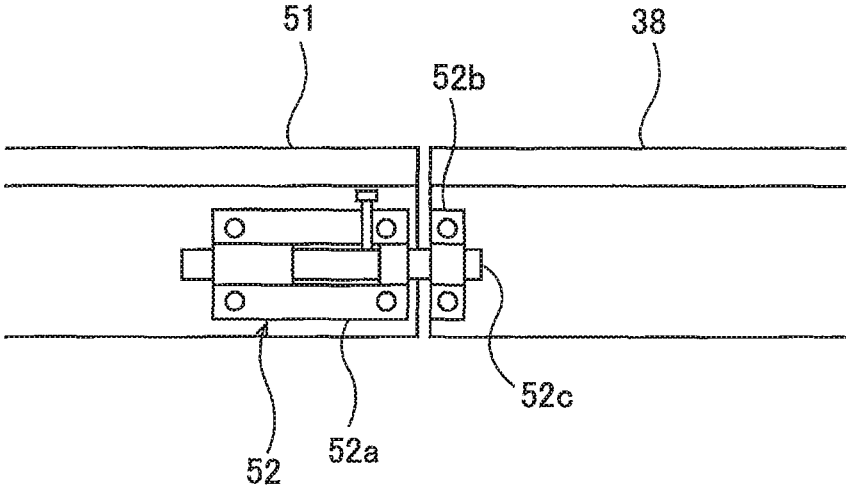
FIG. 17 is a view showing a rail positioning member.

When the second guide rails 51 are not aligned with the first guide rails 38, the substrate-holder carrier 25 may not be able to move from the storage container 20 to the maintenance structure 50. Therefore, a rail positioning member 52 for determining (fixing) a relative position of the first guide rails 38 and the second guide rails 51 is provided on the first guide rail 38 and the second guide rail 51. FIG. 17 is a view showing the rail positioning member 52. In this embodiment, the rail positioning member 52 is a slide-latch. However, the rail positioning member 52 is not limited to the slide-latch as long as the relative position of the first guide rail 38 and the second guide rail 51 can be fixed.

As shown in FIG. 17, the rail positioning member 52 includes a body 52*a* fixed to the second guide rail 51, a seat 52*b* fixed to the first guide rail 38, and a rod 52*c* attached to the body 52*a* and configured to linearly reciprocate between a locking position and an unlocking position. When the rod 52*c* is inserted into a hole formed in the seat 52*b* in a state in which the first guide rail 38 is aligned with the second guide rail 51, the relative position of the first guide rail 38 and the second guide rail 51 is fixed. In this manner, the second guide rail 51 can be prevented from being displaced from the first guide rail 38. Therefore, the substrate-holder carrier 25 can be safely and certainly moved from the storage container 20 to the maintenance structure 50.

Figure 18:
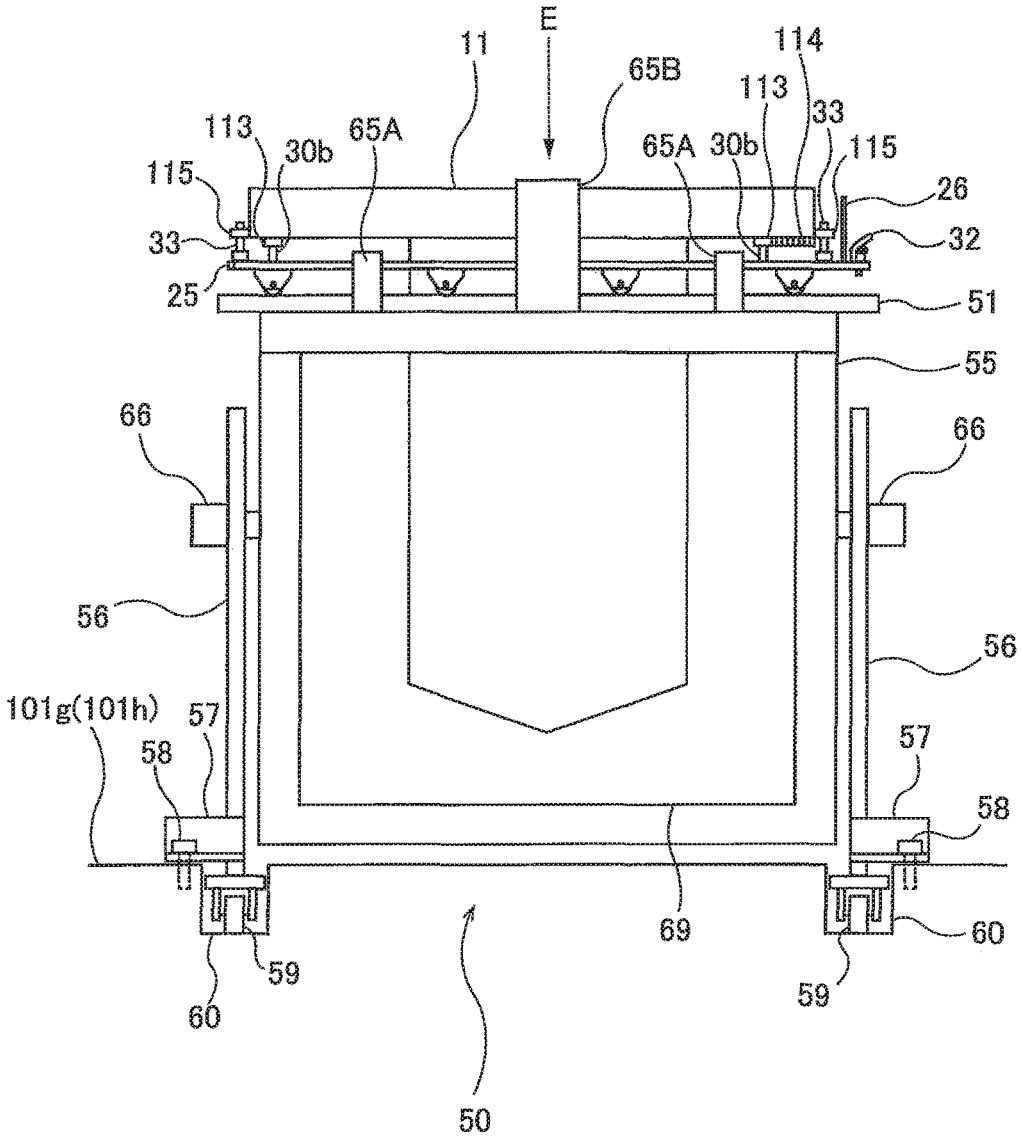
FIG. 18 is a front view of the maintenance structure.

FIG. 18 is a front view of the maintenance structure 50. In FIG. 18, the substrate-holder carrier 25, supporting the substrate holder 11 thereon, is supported by the maintenance structure 50. As shown in FIG. 18, the maintenance structure 50 has wheels 59 which allow the maintenance structure 50 to move parallel to the arrangement direction of the substrate-holder carriers 25. The wheels 59 are attached to a lower end of the supporting member 56.

A fixing plate 57, in which an insertion hole is formed, is secured to a lower part of the supporting member 56. A fixing pin 58 is a pin for fixing the maintenance structure 50 to the pedestal 101, and is to be inserted into the insertion hole of the fixing plate 57. A pin hole, into which the fixing pin 58 is inserted, is formed at a predetermined position in the pedestal 101. The fixing plate 57 is located above the pedestal 101, and a slight gap is formed between the fixing plate 57 and the pedestal 101. Therefore, when the maintenance structure 50 is moved with the fixing pin 58 removed, the fixing plate 57 does not contact the pedestal 101.

The work table 55 is configured to allow passing of the substrate holder 11 which moves from the storage container 20 to the maintenance structure 50. In one embodiment, a slit for allowing passing of the substrate holder 11 is formed in a part of a surrounding wall of the work table 55.

As shown in FIG. 18, an opening 69 is formed in the work table 55. A space, in which the substrate holder 11 is to be housed, is formed in the work table 55. The space in the work table 55 communicates with the outside of the work table 55 (i.e., the maintenance area 21) through the opening 69. Therefore, the worker S can access the substrate holder 11 housed in the space in the work table 55 through the opening 69 of the work table 55.

The work table 55 is rotatably supported by the supporting members 56 through shafts 66. The shafts 66 extend from both sides of the work table 55 to the supporting members 56. The work table 55 can be changed from a vertical position to a horizontal position by rotating about the shafts 66. At this time, the fixing pin 58, which fixes the maintenance structure 50 to the pedestal 101, can prevent the maintenance structure 50 from being moved. Therefore, the worker S can safely change the work table 55 from the vertical position to the horizontal position.

Figure 19:
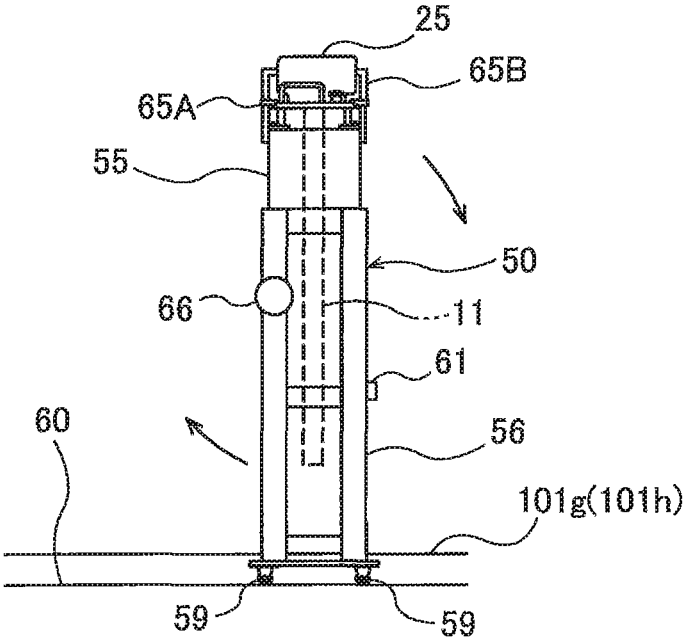
FIG. 19 is a view showing a work table in a vertical position.
Figure 20:
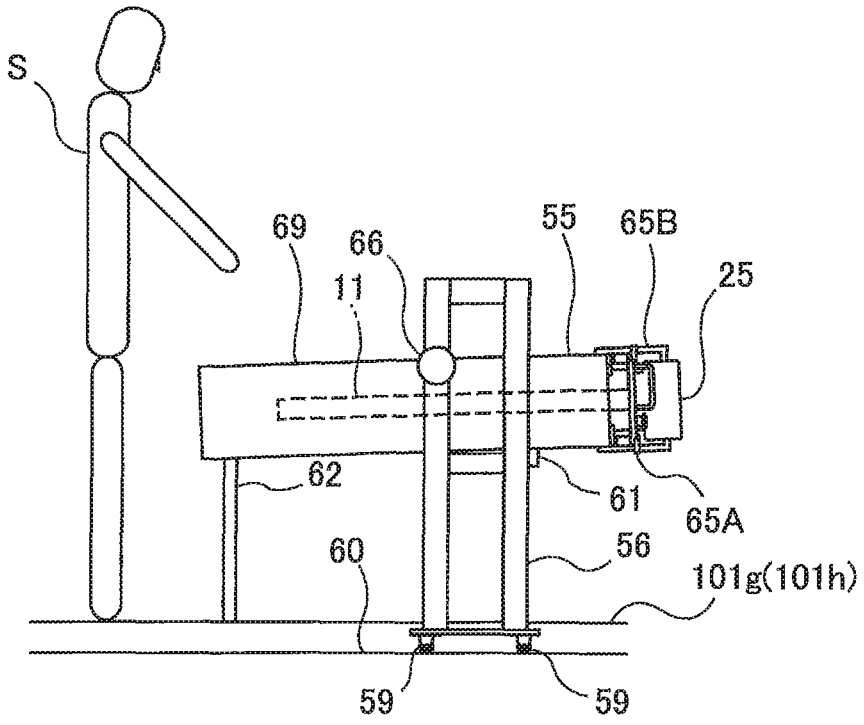
FIG. 20 is a view showing the work table in a horizontal position.

FIG. 19 is a view showing the work table 55 in the vertical position, and FIG. 20 is a view showing the work table 55 in the horizontal position. When the substrate-holder carrier 25, supporting the substrate holder 11, is moved to a predetermined position on the maintenance structure 50, the work table 55 is rotated in the clockwise direction, so that the work table 55 is changed from the vertical position to the horizontal position. The substrate-holder carrier 25 and the substrate holder 11, supported by the maintenance structure 50, are also changed from the vertical position to the horizontal position as the attitude of the work table 55 is changed. Since the opening 69 of the work table 55 and a maintenance surface of the substrate holder 11 face upward by the changing the attitude of the work table 55, the worker S can access the maintenance surface of the substrate holder 11 through the opening 69 of the work table 55. As a result, the worker S can easily conduct the maintenance of the substrate holder 11 in a stable position.

Stoppers 61 for limiting the rotation of the work table 55 are fixed to the supporting members 56, respectively. When the work table 55 is rotated to the horizontal position, the work table 55 is brought into contact with the stoppers 61, which limit the rotation of the work table 55 in the clockwise direction. When leg members 62 (see FIG. 15 and FIG. 20) are placed between the pedestal 101 and the work table 55 in contact with the stoppers 61, a rotation in the counter-clockwise direction of the work table 55 is limited. In this manner, the stoppers 61 and the leg members 62 can limit the rotation of the work table 55 in both directions with respect to the supporting member 56. Therefore, the attitude of the work table 55 can be stabilized.

Figure 21:
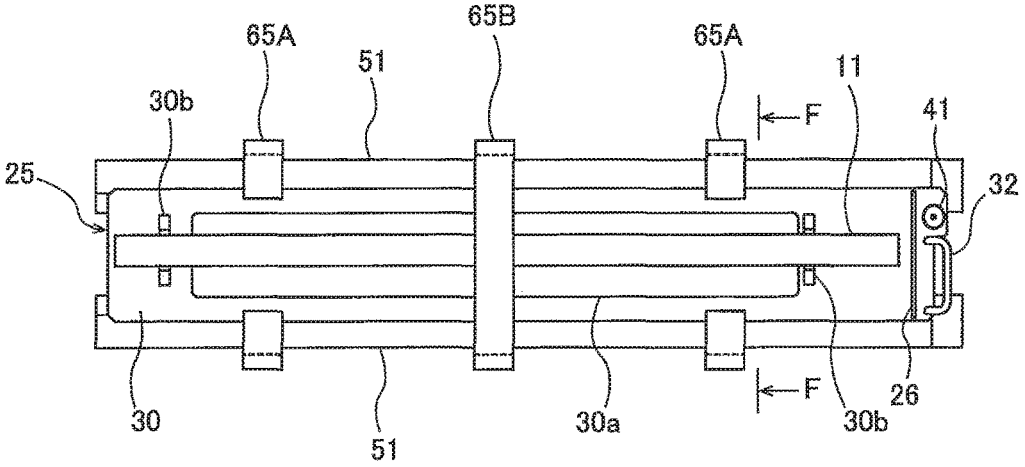
FIG. 21 is a view from a direction indicated by arrow E in FIG. 18.
Figure 22:
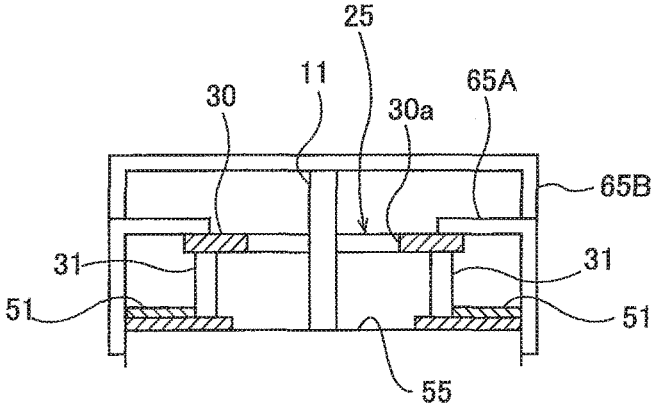
FIG. 22 is a cross-sectional view taken along line F-F in FIG. 21.

FIG. 21 is a view from a direction indicated by arrow E in FIG. 18, and FIG. 22 is a cross-sectional view taken along line F-F in FIG. 21. When the work table 55 is changed from the vertical position to the horizontal position, the substrate holder 11 and/or the substrate-holder carrier 25 may fall off the work table 55. Thus, as shown in FIG. 21 and FIG. 22, the maintenance structure 50 includes carrier supporters 65A for preventing the substrate-holder carrier 25 from falling, and a holder supporter 65B for preventing the substrate holder 11 from falling.

Each of the carrier supporters 65A is constituted by two support elements each having an inverted L shape, and is secured to an upper part of the work table 55. These support elements are bent toward the substrate-holder carrier 25 supported by the second guide rails 51. The bent portions of the carrier supporter 65A are located above the substrate-holder carrier 25, and prevent the substrate-holder carrier 25 from being moved in a direction away from the work table 55. Therefore, when the work table 55 is changed from the vertical position to the horizontal position, the substrate-holder carrier 25 can be prevented from falling off the work table 55.

The holder supporter 65B has a U-shape, and is secured to the upper part of the work table 55. The holder supporter 65B extends across the substrate holder 11 supported by the substrate-holder carrier 25, and prevents the substrate holder 11 from being moved in a direction away from the work table 55. Therefore, when the work table 55 is changed from the vertical position to the horizontal position, the substrate holder 11 can be prevented from falling off the work table 55.

Figure 23:
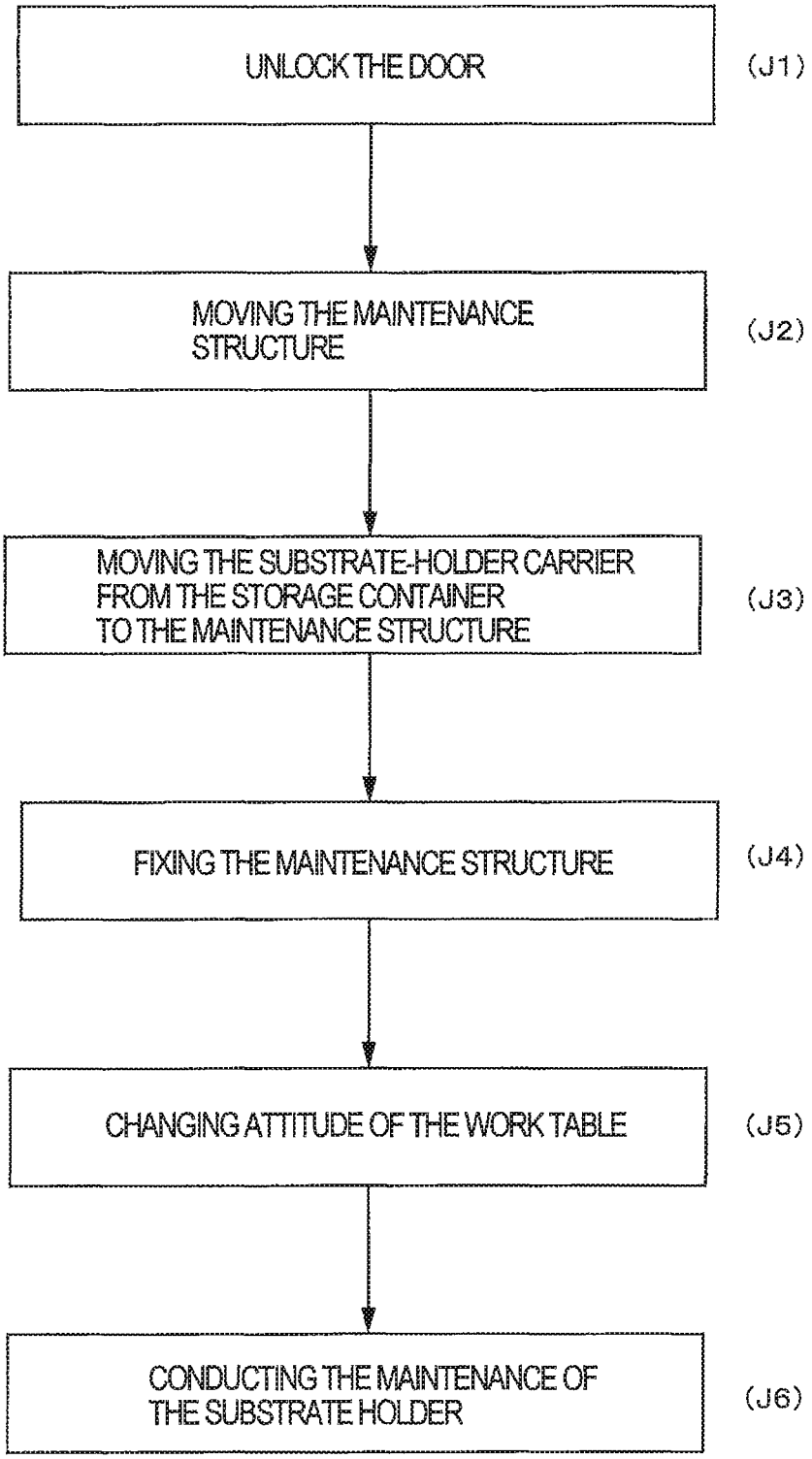
FIG. 23 is a view showing a sequence of moving the substrate holder from the storage container to the maintenance structure.

Next, a sequence of moving the substrate holder 11, supported by the substrate-holder carrier 25, from the storage container 20 to the maintenance structure 50 will be described with reference to FIG. 23. FIG. 23 is a view showing a sequence of moving the substrate holder 11 from the storage container 20 to the maintenance structure 50.

First, in order to move the substrate-holder carrier 25, supporting the substrate holder 11 on which maintenance is to be conducted, to the maintenance structure 50, the door 37 corresponding to that substrate-holder carrier 25 is unlocked (see J1 in FIG. 23). Thereafter, the worker S removes the door 37 that has been unlocked, and moves the maintenance structure 50 so that the second guide rails 51 are aligned with the first guide rails 38 (see J2 in FIG. 23). The worker S then fixes the relative position of the first guide rails 38 and the second guide rails 51 by the rail positioning member 52, and then moves the substrate-holder carrier 25, on which the substrate holder 11 is supported, from the storage container 20 to the maintenance structure 50 through the first guide rails 38 and the second guide rails 51 (see J3 in FIG. 23).

The worker S moves the substrate-holder carrier 25 to a predetermined position on the maintenance structure 50. Thereafter, the worker S moves the maintenance structure 50 to a position at which the attitude of the work table 55 can be changed from the vertical position to the horizontal position, and then fixes the maintenance structure 50 to the pedestal 101 with the fixing pins 58 (see J4 in FIG. 23). Thereafter, the worker S changes the attitude of the work table 55 from the vertical position to the horizontal position (see J5 in FIG. 23). In this state, the worker S sets the leg members 62 between the work table 55 and the pedestal 101 to keep the work table 55 in the horizontal position. Thereafter, the worker S conducts the maintenance of the substrate holder 11 in the maintenance area 21 (see J6 in FIG. 23).

According to the embodiment, the substrate-holder carrier 25 is configured to be movable between the storage container 20 and the maintenance area 21 (more specifically, between the storage container 20 and the maintenance structure 50) while supporting the substrate holder 11. The maintenance area 21 is located outside the moving area in which the transporter 141 moves (see FIG. 3). In other words, the maintenance area 21 is separated away from the moving area of the transporter 141. Therefore, the worker S in the maintenance area 21 can move the substrate-holder carrier 25 to the maintenance area 21 (more specifically, to the maintenance structure 50) together with the substrate holder 11 without touching the moving transporter 141. As a result, the worker S can safely conduct the maintenance of the substrate holder 11 while the operation of the plating apparatus is being performed. In this manner, reliability and productivity of the plating apparatus can be improved.

Since the substrate holder 11 holding the substrate W is immersed in the process liquid held in the processing tank, the process liquid may remain on the substrate holder 11 when the substrate holder 11 is moved over the storage container 20 by the transporter 141. According to the embodiment, since the substrate-holder carrier 25 is movable independently of the storage container 20, the storage container 20 is allowed to stay as it is and always exists in a predetermined position, even after the substrate-holder carrier 25 has been moved to the maintenance area 21 (more specifically, to the maintenance structure 50). Therefore, even if the processing liquid falls off the substrate holder 11 that is being transported over the storage container 20, the processing liquid can be certainly recovered.

In recent years, with the increase in the size of the substrate, the size of the substrate holder has also increased, and its weight has also increased. Therefore, performing the maintenance work inside the apparatus rather than performing the maintenance work outside the apparatus by moving the large-sized substrate holder outside the plating apparatus is desirable, because it leads to reduce a work burden on the worker S. According to the embodiment, since the worker S can perform maintenance of the substrate holder 11 in the maintenance area 21 in the plating apparatus, it is not necessary to move the substrate holder 11 outside the plating apparatus. As a result, the time required for maintenance of the substrate holder 11 can be shorted.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A plating apparatus comprising:

a processing section configured to plate a substrate;

a storage container configured to store a substrate holder, the substrate holder configured to hold the substrate;

a transport machine configured to transport the substrate holder between the processing section and the storage container;

a maintenance area adjacent to the storage container;

a frame provided in the maintenance area, the frame being adjacent to the transport machine, and the frame having a size that allows maintenance of the substrate holder to be conducted in the maintenance area;

a substrate-holder carrier supported by the storage container, the substrate-holder carrier being movable between the storage container and the maintenance area while supporting the substrate holder that needs maintenance during an operation of the transport machine;

a pedestal configured to partition an inside portion of the plating apparatus from an outside portion, wherein the processing section, the storage container, the maintenance area, and the substrate-holder carrier are disposed in the inside portion of the plating apparatus, and wherein the processing section, the storage container, and the transport machine are disposed outside the frame.

2. The plating apparatus according to claim 1, further comprising:

a partition arranged between the maintenance area and the storage container, the partition being located higher than the storage container.

3. The plating apparatus according to claim 1, wherein the storage container has a door facing the maintenance area, and a locking mechanism is attached to the door.

4. The plating apparatus according to claim 1, further comprising:

a detection sensor configured to detect whether the substrate-holder carrier exists at a predetermined position on the storage container.

5. The plating apparatus according to claim 1, wherein:

the storage container includes a box in which the substrate holder is stored; and a bottom surface of the box has a slope shape.

6. The plating apparatus according to claim 1, wherein:

the substrate holder includes a main body having a first member and a second member configured to sandwich the substrate, and an arm portion provided on an upper end of the main body, and the substrate-holder carrier is movable between the storage container and the maintenance area in a state in which the arm portion is located on the substrate-holder carrier and the first member is located below the substrate-holder carrier.

7. The plating apparatus according to claim 1, wherein the transport machine includes a fixed base which extends horizontally, and a transporter which is configured to be movable along the fixed base, and the fixed base and the maintenance area are arranged on both sides of the storage container.

8. The plating apparatus according to claim 7, wherein the fixed base is located outside a movement path of the substrate-holder carrier.

9. The plating apparatus according to claim 5, wherein the bottom surface of the box is a slope surface which is inclined downwardly toward a maintenance-area-side.

10. A plating apparatus comprising:

a processing section configured to plate a substrate;

a storage container configured to store a substrate holder, the substrate holder configured to hold the substrate;

a transport machine configured to transport the substrate holder between the processing section and the storage container;

a maintenance area adjacent to the storage container;

a frame provided in the maintenance area, the frame being adjacent to the transport machine;

a substrate-holder carrier supported by the storage container, the substrate-holder carrier being movable between the storage container and the maintenance area while supporting the substrate holder that needs maintenance during an operation of the transport machine;

a pedestal configured to partition an inside portion of the plating apparatus from an outside portion, wherein the processing section, the storage container, the maintenance area, and the substrate-holder carrier are disposed in the inside portion of the plating apparatus, and wherein the substrate-holder carrier includes:

a base on which the substrate holder is placed; and a rolling element attached to the base, the rolling element being in contact with the storage container.

11. The plating apparatus according to claim 10, further comprising:

a maintenance structure located in the maintenance area, the maintenance structure being configured to receive the substrate holder and the substrate-holder carrier, wherein the storage container includes a first guide rail configured to support the rolling element, the maintenance structure includes a second guide rail configured to support the rolling element, and the second guide rail is configured to be able to be aligned with the first guide rail.

12. The plating apparatus according to claim 11, wherein:

a plurality of substrate-holder carriers are arranged on the storage container; and the maintenance area extends parallel to an arrangement direction of the substrate-holder carriers.

13. The plating apparatus according to claim 12, wherein the maintenance structure is movable parallel to the arrangement direction of the substrate-holder carriers.

14. The plating apparatus according to claim 13, wherein the maintenance structure has a wheel which allows the maintenance structure to move parallel to the arrangement direction of the substrate-holder carriers.

15. The plating apparatus according to claim 10, wherein the base includes an opening having a size that the substrate holder is inserted therein, and holder receiving portions on which the substrate holder is supported.

16. A plating apparatus comprising:

a processing section configured to plate a substrate;

a storage container configured to store a substrate holder, the substrate holder configured to hold the substrate;

a transport machine configured to transport the substrate holder between the processing section and the storage container;

a maintenance area adjacent to the storage container;

a substrate-holder carrier supported by the storage container, the substrate-holder carrier being movable between the storage container and the maintenance area while supporting the substrate holder; and a maintenance structure located in the maintenance area, the maintenance structure being configured to receive the substrate holder and the substrate-holder carrier, wherein the substrate-holder carrier includes:

a base on which the substrate holder is placed; and a rolling element attached to the base, the rolling element being in contact with the storage container, wherein the storage container includes a first guide rail configured to support the rolling element, wherein the maintenance structure includes a second guide rail configured to support the rolling element, wherein the second guide rail is configured to be able to be aligned with the first guide rail, and wherein the maintenance structure includes:

a work table secured to the second guide rail and extending downwardly from the second guide rail; and a support member rotatably supporting the work table.

* * * * *